US006976366B2

(12) United States Patent
Starling et al.

(10) Patent No.: US 6,976,366 B2
(45) Date of Patent: Dec. 20, 2005

(54) BUILDING SYSTEM PERFORMANCE ANALYSIS

(75) Inventors: Neal Starling, Canton, GA (US); Paul Wickberg, Marietta, GA (US); Thomas J. Mathews, Fayette, ME (US)

(73) Assignee: Emerson Retail Services Inc., Kennesaw, GA (US)

( * ) Notice: Subject to any disclaimer, the term of this patent is extended or adjusted under 35 U.S.C. 154(b) by 82 days.

(21) Appl. No.: 10/696,392

(22) Filed: Oct. 29, 2003

(65) Prior Publication Data

US 2004/0163396 A1 Aug. 26, 2004

Related U.S. Application Data

(63) Continuation of application No. PCT/US02/13452, filed on Apr. 29, 2002.

(60) Provisional application No. 60/287,458, filed on Apr. 30, 2001.

(51) Int. Cl.[7] ..... F24F 7/00

(52) U.S. Cl. ..... 62/126; 700/276; 165/11.1

(58) Field of Search ..... 62/125, 126, 127, 62/129, 130, 131; 236/94; 165/11.1; 700/45, 700/276, 277, 278

(56) References Cited

U.S. PATENT DOCUMENTS

| | | | |
|---|---|---|---|
| 5,573,181 | A | 11/1996 | Ahmed |
| 5,579,993 | A | 12/1996 | Ahmed et al. |
| 5,596,507 | A | 1/1997 | Jones et al. |
| 6,095,426 | A | 8/2000 | Ahmed et al. |

OTHER PUBLICATIONS

International Search Report for PCT/US02/13452; ISA/US; date mailed Nov. 29, 2002.

*Primary Examiner*—Harry B. Tanner
(74) *Attorney, Agent, or Firm*—Harness, Dickey & Pierce, P.L.C.

(57) ABSTRACT

A method for improving system performance in a building environment according to the invention includes installing a temperature monitoring system for a refrigeration system, and performing a temperature audit on the refrigeration system. Temperature and pressure sensors are calibrated, and operating parameters of the refrigeration system are obtained. Pressure drop and efficiency tests are performed on at least one component of the refrigeration system, and operating pressures of at least one component are adjusted. System stability is tracked. In one embodiment, the building environment further includes an HVAC system and the method includes adjusting the HVAC system according to desired presets. In another embodiment, the building environment includes a lighting system and the method includes adjusting internal lighting levels of the lighting system to desired set points.

91 Claims, 6 Drawing Sheets

BUILDING SYSTEM PERFORMANCE ANALYSIS

CROSS-REFERENCE TO RELATED APPLICATIONS

This application is a continuation of International Application No. PCT/US02/13452, filed Apr. 29, 2002, which claims the benefit of U.S. Provisional Application No. 60/287,458, filed on Apr. 30, 2001. The disclosures of the above applications are incorporated herein by reference.

FIELD OF THE INVENTION

The present invention relates to analyzing building system performance and, more particularly, to a method for improving the performance of refrigeration, HVAC, lighting, anti-condensate heating and other systems.

DISCUSSION OF THE INVENTION

Prior attempts to analyze building system performance have been completed piecemeal, without integrating the analysis of the various aspects of each building system component, nor taking a macro-analytical approach. Thus, such analysis has been limited to components of the system. Such a micro-analytical approach is too focused, and not nearly comprehensive enough to provide accurate performance analysis and achieve improved system performance.

The present invention provides a method for examining building system performance, including the performance of refrigeration, HVAC, lighting, and other control systems. According to the invention, a series of proscribed tests and adjustment procedures are performed using a combination of remote monitoring and on-site technicians to achieve improved system performance.

The method of improving refrigeration performance according to the present invention is summarized by the following steps. Initially, monitoring devices are installed. Based on this information, a performance audit is then performed, and calibration procedures are conducted. After application parameters are obtained, proscribed system tests are performed. Initial adjustments are made to equipment, controls and systems according to the present settings. Then, resulting system stability is tracked, followed by re-adjustment of set points and operating parameters, until system performance goals are met.

Further areas of applicability of the present invention will become apparent from the detailed description provided hereinafter. It should be understood that the detailed description and specific examples, while indicating the preferred embodiment of the invention, are intended for purposes of illustration only and are not intended to limited the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
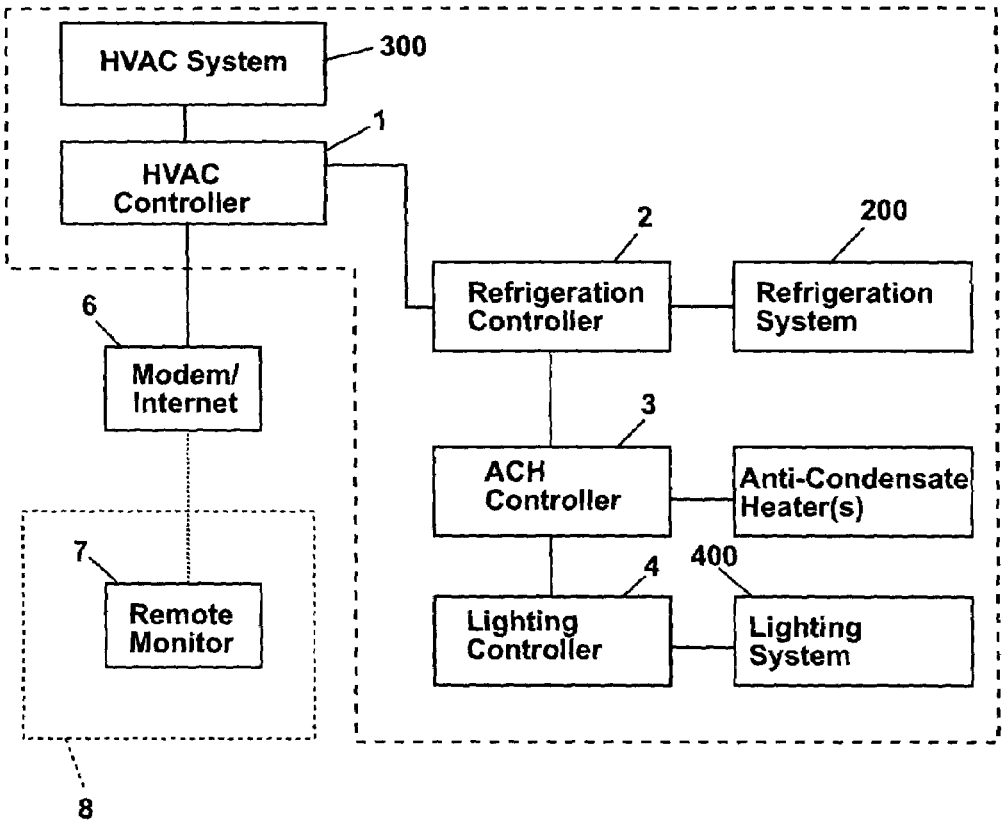
FIG. 1 is a schematic illustration of a building system for use with the method for analyzing the building system performance according to the principles of the present invention.

According to the invention, building system performance analysis provides a comprehensive building system assessment and energy management solution. The method according to the invention is particularly applicable to refrigeration, HVAC, light, anti-condensate heater (ACH), and defrost control systems. As shown in FIG. 1, an HVAC controller 1 is in communication with a refrigeration controller 2, an ACH condensate heater controller 3, and a lighting controller 4. These components would typically be located in a building 5. Further, the HVAC controller 1 is in communication via a modem or internet connection 6 to a remote monitor 7 at a remote location 8. As shown, the HVAC controller 1 is in communication with the HVAC system, with the refrigeration controller 2, the ACH controller 3, and the lighting controller 4, which are each in communication, respectively, with the refrigeration system, the anti-condensate heaters, and lighting system. Note that the HVAC controller 1 is shown as a communication gateway between the various controllers 2, 3, 4 and the remote monitor 7, but any of the controllers 1–4 can function as the communication gateway. Preferably, the HVAC controller 1 or refrigeration controller 2 function as the communication gateway. Alternatively, each controller 1, 2, 3, 4 can be connected to a network backbone that has a dedicated communication gateway to provide Internet, modem or other remote access. Further, more or fewer building control systems may be included, and the illustration of FIG. 1 is merely exemplary.

Figure 2:
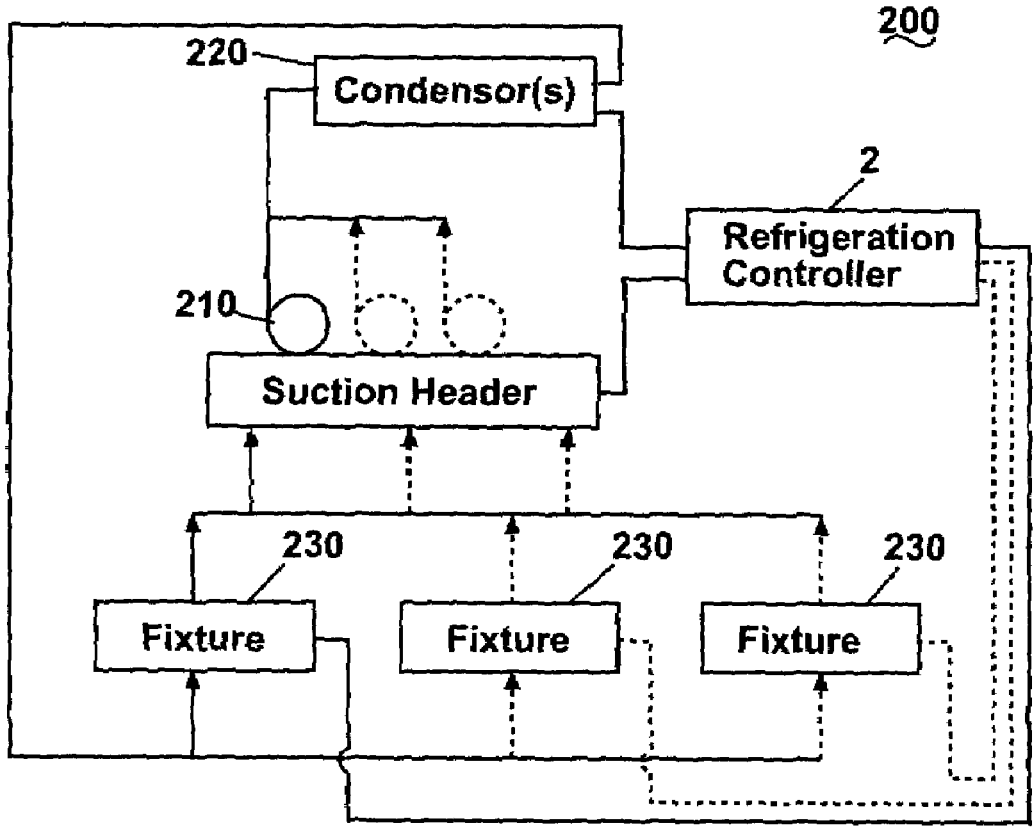
FIG. 2 is a schematic illustration of an exemplary refrigeration system according to the principles of the present invention.

With reference to FIG. 2, a basic refrigeration system 200 is shown for illustrative purposes. Note that the refrigeration system 200 may include one or more compressors 210, condensers 220, and refrigeration fixtures 230. Note also that the condensers, compressors, and refrigeration fixtures are in communication with the refrigeration controller 2. Such communication may be networked, dedicated direct connections, or wireless.

Figure 3:
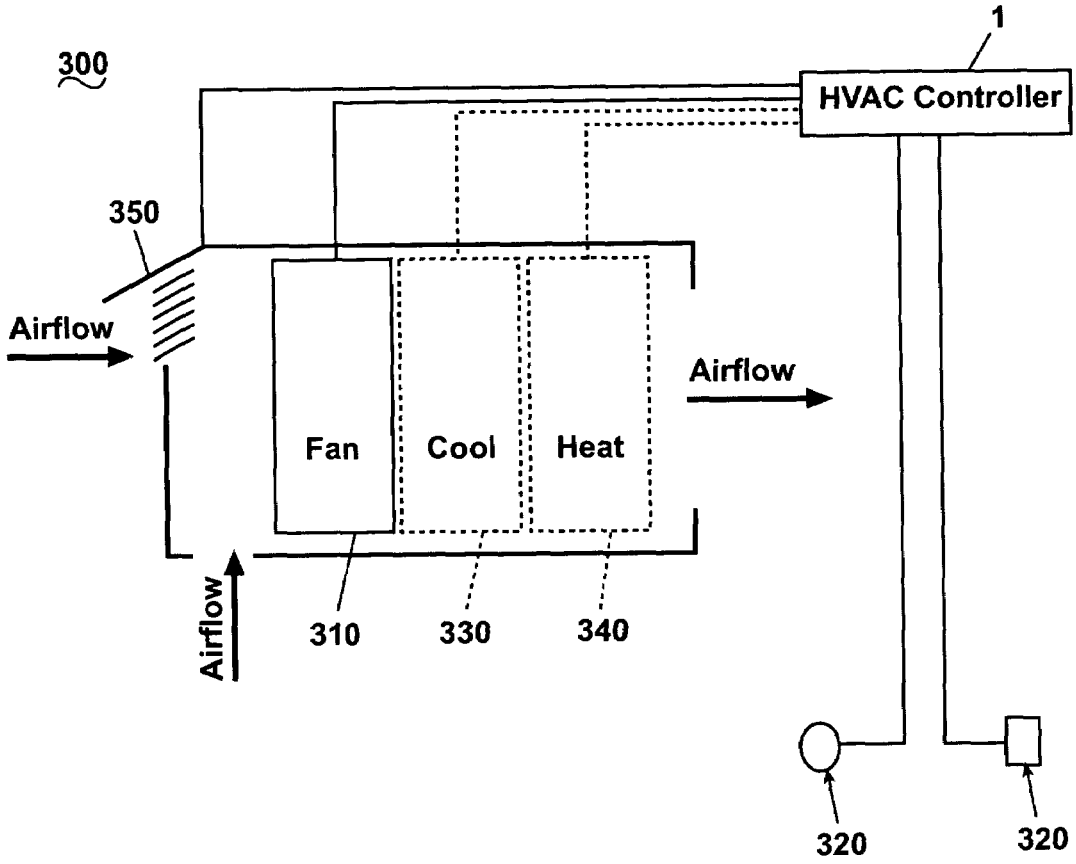
FIG. 3 is a schematic illustration of an exemplary HVAC system according to the principles of the present invention.

Similarly with FIG. 3, an exemplary HVAC system 300 is shown for illustrative purposes. As shown, the HVAC controller 1 is in communication with a fan 310 and sensors 320, as well as a cooling apparatus 330, heating apparatus 340, and damper 350, if appropriate. The fan 310, cooling apparatus 330, heating apparatus 340, and damper 350 are in communication with the HVAC controller 1. Such communication may be networked, dedicated direct connections, or wireless.

Figure 4:
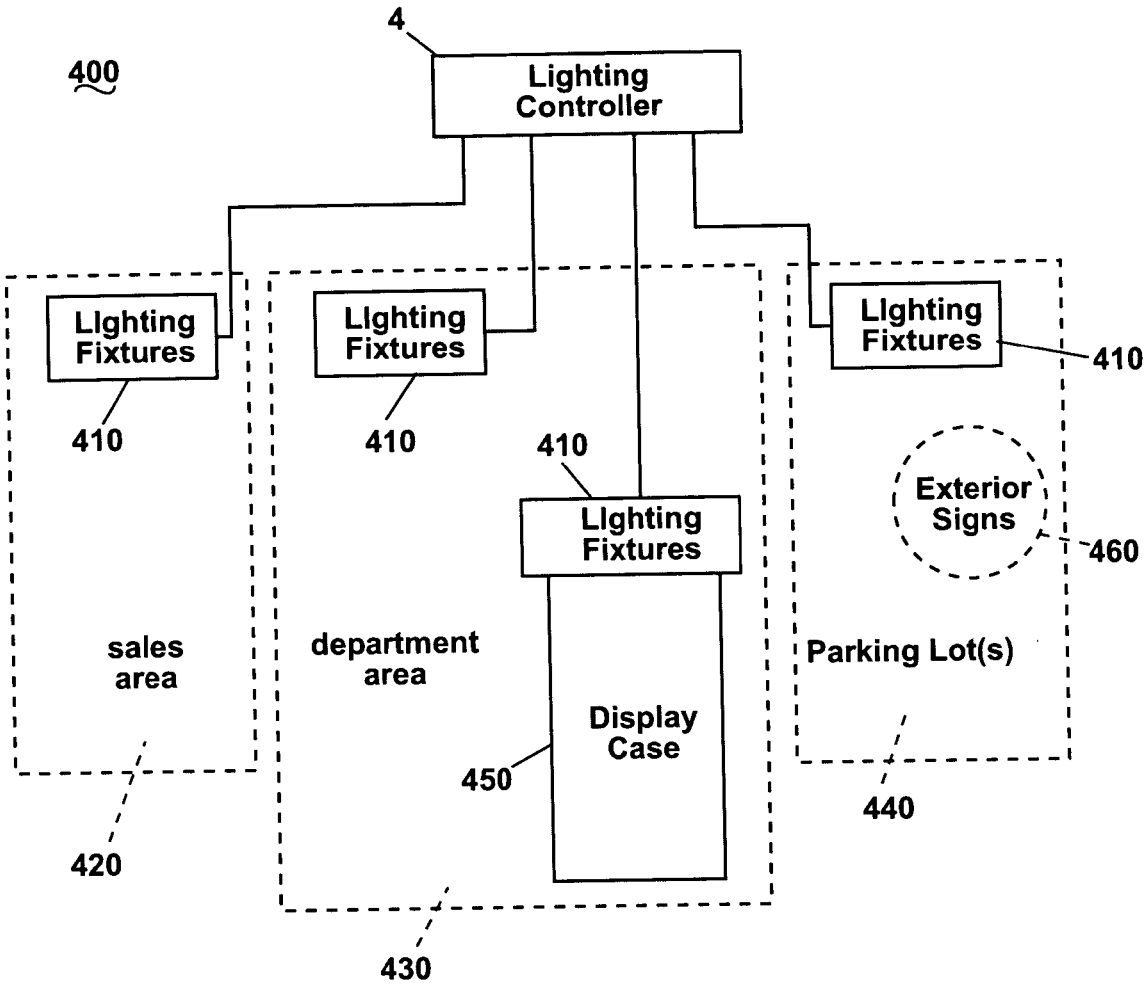
FIG. 4 is a schematic illustration of an exemplary lighting system according to the principles of the present invention.

Finally, and again for exemplary purposes, FIG. 4 shows a lighting system 400 for illustrative purposes. As shown, one or more lighting fixtures 410 are being shown in communication with the lighting controller 4. Note that the various lighting fixtures 410 are shown in various areas of the building and its exterior, and some areas include multiple types of fixtures while lighting fixtures for multiple areas may also be similarly controlled. For example, FIG. 4 illustrates the sales area 420, a department area 430, and a parking lot 440. The department area 430 includes lighting fixtures 410 for the department area 430 as well as lighting fixtures 410 for display cases 450 in the department area 430. Also, the parking lot 440 includes lighting fixtures 410 as well as an exterior sign lighting 460. The various lighting fixtures 410 are in communication with the lighting controller 4. Such communication may be networked, dedicated direct connections, or wireless.

Figure 5:
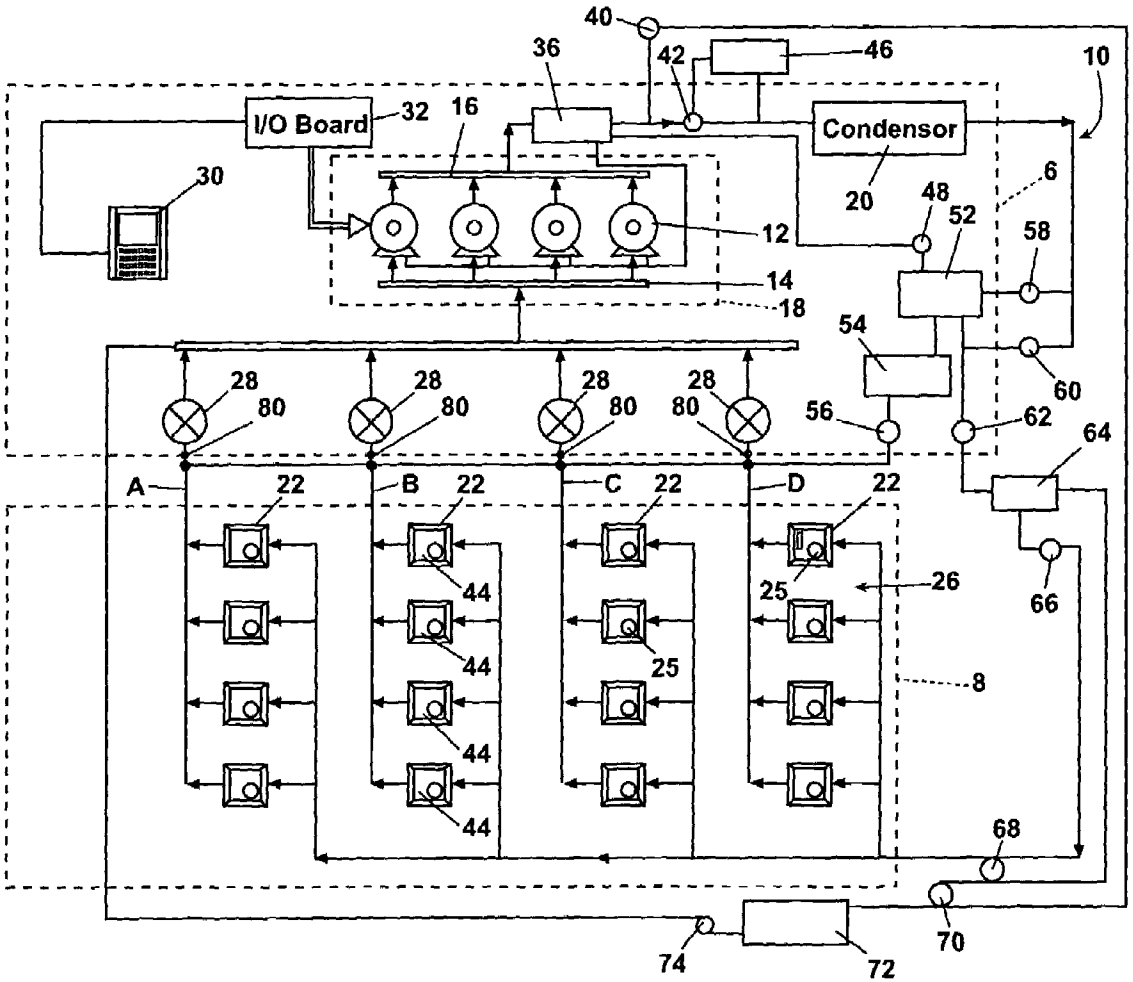
FIG. 5 is a detailed schematic illustration of an exemplary refrigeration system according to the principles of the present invention.

With reference to FIG. 5, a detailed block diagram of an exemplary refrigeration system 10 is shown for explanation purposes. Note that any such system including HVAC, lighting, ACH, defrost, etc., can be performance-analyzed according to the invention. A more detailed explanation of the exemplary refrigeration system 10 follows.

The refrigeration system 10 includes a plurality of compressors 12 piped together with a common suction header 14 and a discharge header 16 all positioned within a compressor rack 18. The compressor rack 18 compresses refrigerant vapor that is delivered to an oil separator 36 whereby the vapor is delivered from a first line to a hot gas defrost valve 40 and a three-way heat reclaim valve 42. The hot gas defrost valve 40 allows hot gas to flow to the evaporator through liquid line solenoid valve 70 and solenoid valve 68. The heat reclaim valve 42 allows hot gas to flow to the heat reclaim coils 46 and to a condenser 20 where the refrigerant vapor is liquefied at high pressure.

A second line of the oil separator 36 delivers gas through a receiver pressure valve 48 to a receiver 52. The receiver pressure valve 48 ensures the receiver pressure does not drop below a set value. The condenser 20 sends fluid through a condenser flood back valve 58 to receiver 52. The condenser flood back valve 58 restricts the flow of liquid to the receiver 52 if the condenser pressure becomes too low. EPR valves 28 are mechanical control valves used to maintain a minimum evaporator pressure in the cases 22. The valve operates by restricting or opening a control orifice to raise or lower the pressure drop across the valve, thereby maintaining a steady valve inlet (and associated evaporator pressure even as the evaporator load or rack suction pressure varies in response to the addition or deletion of compressor capacity or other factors. A surge valve 60 allows liquid to bypass the receiver 52 when it is subcooled in the ambient. Accordingly, ambient subcooled liquid joins liquid released from the receiver 52, and is then delivered to a differential pressure regulator valve 62. During defrost, the differential pressure regulator valve 62 will reduce pressure delivered to the liquid header 64. This reduced pressure allows reverse flow through the evaporator during defrost. Liquid flows from liquid header 64 via a first line through a liquid branch solenoid valve 66, which restricts refrigerant to the evaporators during defrost but allows back flow to the liquid header 64. A second line carries liquid from the liquid header 64 to the hot gas defroster 72 where it exits to an EPR/Sorit valve 74. The EPR/Sorit valve 74 adjusts so the pressure in the evaporator is greater than the suction header 14 to allow the evaporator to operate at a higher pressure.

The high-pressure liquid refrigerant leaving liquid branch solenoid valve 66 is delivered to a plurality of refrigeration cases 22 by way of piping 24. Circuits 26 consisting of a plurality of refrigeration cases 22 operate within a certain temperature range. FIG. 5 illustrates four (4) circuits 26 labeled circuit A, circuit B, circuit C and circuit D. Each circuit 26 is shown consisting of four (4) refrigeration cases 22. However, those skilled in the art will recognize that any number of circuits 26, as well as any number of refrigeration cases 22 may be employed within a circuit 26. As indicated, each circuit 26 will generally operate within a certain temperature range. For example, circuit A may be for frozen food, circuit B may be for dairy, circuit C may be for meat, etc.

Because the temperature requirement is different for each circuit 26, each circuit 26 includes a EPR valve 28 which acts to control the evaporator pressure and, hence, the temperature of the refrigerated space in the refrigeration cases 22. The EPR valves 28 can be electronically or mechanically controlled. Each refrigeration case 22 also includes its own expansion valve that may be either a mechanical or an electronic valve for controlling the superheat of the refrigerant. In this regard, refrigerant is delivered by piping to the evaporator in each refrigeration case 22. The refrigerant passes through an expansion valve where a pressure drop causes the high pressure liquid refrigerant to become a lower pressure combination of liquid and vapor. As the hot air from the refrigeration case 22 moves across the evaporator coil, the low pressure liquid turns into gas. This low pressure gas is delivered to the pressure regulator 28 associated with that particular circuit 26. At EPR valves 28, the pressure is dropped as the gas returns to the compressor rack 18. At the compressor rack 18, the low pressure gas is again compressed to a high pressure gas, which is delivered to the condenser 20, which creates a high pressure liquid to supply to the expansion valve and start the refrigeration cycle over.

A main refrigeration controller 30 is used and configured or programmed to control the operation of the refrigeration system 10. The refrigeration controller 30 is preferably an Einstein Area Controller offered by CPC, Inc. of Atlanta, Ga., U.S.A., or any other type of programmable controller which may be programmed, as discussed herein. The refrigeration controller 30 controls the bank of compressors 12 in the compressor rack 18, via an input/output module 32. The input/output module 32 has relay switches to turn the compressors 12 on an off to provide the desired suction pressure. A separate case controller, such as a CC-100 case controller, also offered by CPC, Inc. of Atlanta, Ga., U.S.A., may be used to control the superheat of the refrigerant to each refrigeration case 22, via an electronic expansion valve in each refrigeration case 22 by way of a communication network or bus 34. Alternatively, a mechanical expansion valve may be used in place of the separate case controller. Should separate case controllers be utilized, the main refrigeration controller 30 may be used to configure each separate case controller, also via the communication bus 34. The communication bus 34 may either be a RS-485 communication bus or a LonWorks Echelon bus that enables the main refrigeration controller 30 and the separate case controllers to receive information from each case 22.

Each refrigeration case may have a temperature sensor 44 associated therewith, as shown for circuit B. The temperature sensor 44 can be electronically or wirelessly connected to the controller 30 or the expansion valve for the refrigeration case. Each refrigeration case 22 in the circuit B may have a separate temperature sensor 44 to take average/min/max temperatures or a single temperature sensor 44 in one refrigeration case 22 within circuit B may be used to control each case 22 in circuit B because all of the refrigeration cases 22 in a given circuit operate in substantially the same temperature range. These temperature inputs are preferably provided to the analog input board 38, which returns the information to the main refrigeration controller via the communication bus 34.

The present invention provides a method for improving building system performance. In general, the method includes an examination of existing system conditions and operating parameters using a combination of remote monitoring and on-site technicians. A series of proscribed testing and adjustment procedures are also conducted using a combination of remote monitoring and on site technicians. A continuous follow-up process and associated feedback loop activities are implemented to maintain the system in an enhanced performance state.

While the present invention is discussed in detail below with respect to specific components as contained in refrigeration system 10, the present invention may be employed with other types of refrigeration systems containing other components operable to be configured to provide substantially the same results as discussed herein. HVAC, lighting, ACH, defrost, etc., are common building systems that can also be analyzed and improved according to the methods described next.

Initially, application-specific operating parameters are determined. For the refrigeration system 10, these include minimum, maximum and average pressures and temperatures, as well as defrost schedules and other relevant refrigeration system data. On-site technicians use service gauge sets, light meters, infrared thermometers, ammeters, velometers and superheat recorders to obtain system operating data.

Figure 6:
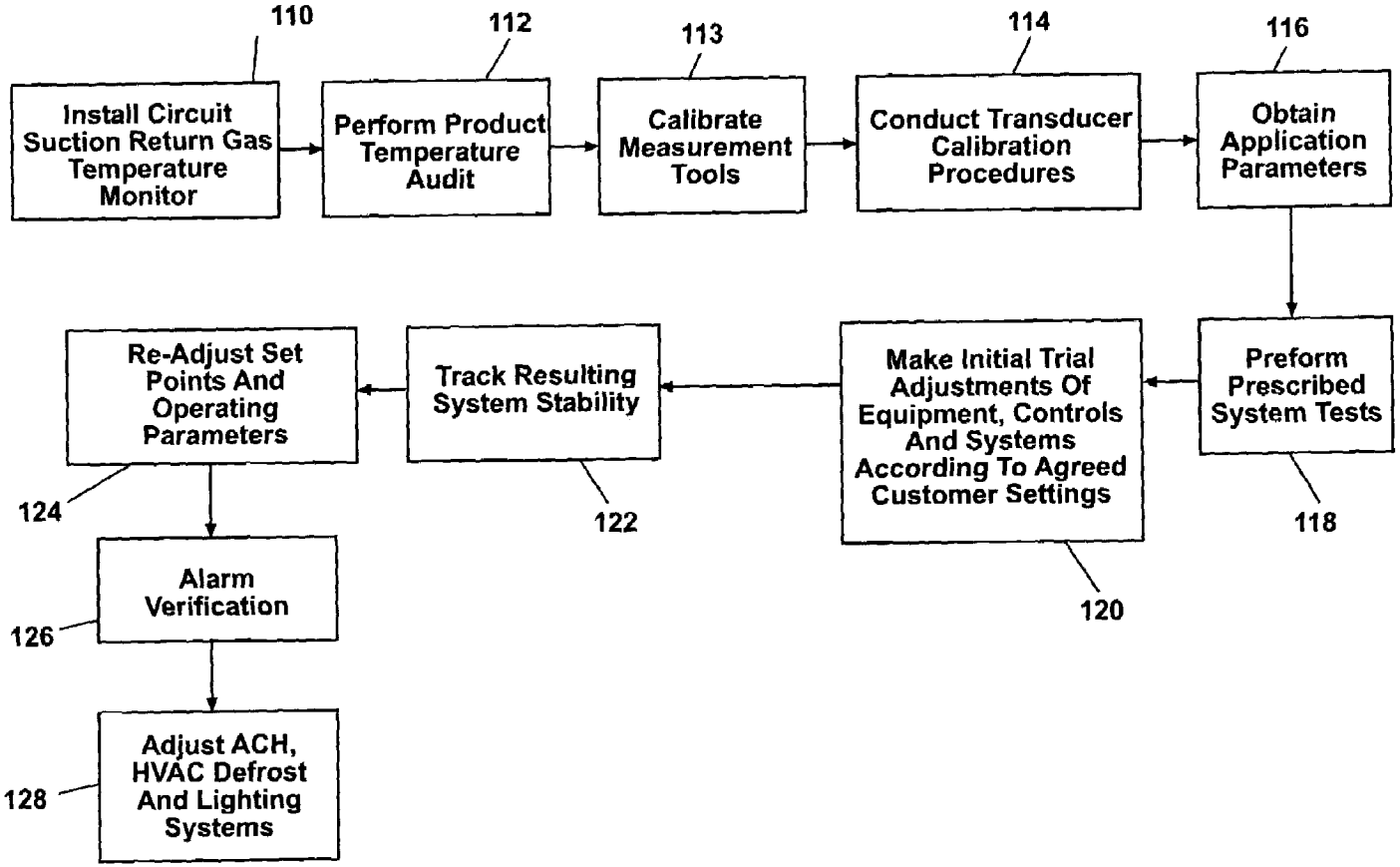
FIG. 6 is a flowchart outlining a method for optimizing building system performance.

An illustration of the on-site steps to be conducted is outlined in FIG. 6. First, the circuit suction gas temperature monitor is installed and started at step 110. Next, a product temperature audit is performed at step 112. Transducer calibration procedures are then conducted at step 114. Application parameters are obtained at step 116, such as existing conditions, actual operating pressures and temperatures, defrost schedules and equipment component information. Proscribed system tests are performed at step 118 to identify system savings opportunities. Initial trial adjustments are then made at step 120 of equipment, controls and systems according to customer specific parameters. The resulting system stability and performance is tracked at step 122. The set-points and operating parameters are re-adjusted at step 124 to improve overall system performance and eliminate any unacceptable product temperatures or equipment operating conditions. Alarm verification at step 126 is then performed. Finally, adjustments at step 128 of refrigeration, HVAC and lighting time-of-day (TOD) settings are then made according to customer parameters.

The on-site steps as outlined above will now be described in greater detail. To install the circuit suction return gas temperature monitor, the monitor is positioned near the compressors in the machine room 90 in a location that does not interfere with machine-room traffic but, if possible, still allows the superheat sensor and cable assemblies to reach all of the individual refrigeration system circuit suction lines. Once the monitor is placed in an adequate position, it is plugged into a source of continuous power and powered on. Configuration of the controller for the current application is then verified.

The temperature sensors are then attached using wire ties to their assigned circuit suction line, preferably before any EPR or temperature control valve. If the circuit suction lines are insulated, the temperature sensors are preferably positioned under the existing insulation. Where no insulation is present, an adequate amount of insulation, preferably about four (4) inches, is disposed over the temperature probe. The sensor assignments and installation is then rechecked. The monitor display is then checked to make sure all sensors are reading.

Next, the circuits 26 having low return gas superheats are identified. The minimum return gas superheat is the difference between the rack suction temperature and the individual circuit return gas temperatures. The minimum return gas superheat should read at a desired temperature, such as twenty-five (25) degrees Fahrenheit. In general, for any case 22 requiring or compressor rack 18 providing an evaporator temperature below zero (0) degrees Fahrenheit, a minimum acceptable return temperature is about ten (10) degrees Fahrenheit. Similarly, any case 22 requiring or compressor rack 18 providing an evaporator temperature between about zero (0) and about twenty-five (25) degrees Fahrenheit, a minimum acceptable return temperature is about thirty-five (35) degrees Fahrenheit. From these readings, the suction groups having low return gas superheats can be identified. The minimum superheat between the evaporator and suction header is determined by the requirements of the application.

The temperature audit at step 112 will now be described in more detail. At the outset, a hand held infrared thermometer gun 100 is calibrated by filling a container such as a disposable coffee or drink cup half full with an approximately even mix of ice and water. The mixture is stirred thoroughly. A measurement is taken of the ice-bath temperature directly with the infrared thermometer 100. The observed temperature is recorded. The high, low and average product temperature for each refrigeration fixture is then measured using the hand-held infrared thermometer gun 100. The case or walk-in designation for each refrigeration fixture and the product type displayed or stored in the fixture is then recorded. Next, the temperature is measured in each fixture by sweeping the hand-held infrared thermometer guns target circle slowly from top to bottom in the fixture as the technician moves from left to right. While taking temperature readings, it is important to avoid scanning the discharge air honeycombs and coil faces. The highest and lowest temperature observed for each fixture is then recorded. The discharge air temperature is scanned by pointing the infrared gun 100 through the discharge-air opening or honeycomb directly into the discharge air plenum or coil body. The lowest discharge air temperature is then recorded. The case temperature sensors are preferably calibrated where present while determining current fixture and product temperatures.

Calibration of the electric temperature and pressure sensors at step 114 will now be described. In general, when checking a pressure sensor (transducer) for accuracy, electronic display and gauge pressure readings are taken simultaneously. The gauges must be zeroed and connected as close to the electronic sensor as possible. When recording unsteady pressure readings, an estimated pressure may be entered. When checking a temperature sensor for accuracy, a test thermometer is placed as close as possible to the sensor being checked. Where sensor temperature is substantially different from ambient temperature, both the probe for the test thermometer and the temperature sensor are wrapped with insulation and the temperatures are allowed to equalize.

Before the pressure transducers are checked for accuracy, the pressure gauges are calibrated according to the following procedure at step 113. Two high-side gauges are labeled permanently as "A" and "B" gauges respectively. The high-side gauges are opened to atmospheric and zeroed. Next, both gauges are connected to a calibration cylinder containing HP80 refrigerant. The thermometer on the cylinder is read. The associated pressure is then referenced in a refrigerant pressure-temperature (P-T) conversion chart and recorded along with the gauge readings. If the gauge readings differ from the actual cylinder pressure by more than about five (5) psig, the gauges must be replaced. If the gauge readings differ from one another by more than about five (5)

psig, the gauge with the biggest reading deviation from the actual cylinder pressure is replaced. Next, two low-side pressure gauges are labeled as "A" and "B" respectively. Each low pressure gauge is opened to atmospheric pressure and zeroed. Both gauges are then connected to the lowest pressure suction header 14 and the readings recorded. Both gauges are then connected to the highest pressure suction header 14 and the readings recorded. If the gauge readings differ by more than about two (2) psig, the least accurate gauge is replaced.

Next, high-side pressure transducers and suction-pressure transducers are checked, where present, and recorded. The rack-temperature sensors for discharge, drop leg, liquid header, subcooler inlet and outlet, sump temps and other readings are tested where appropriate. HVAC transducers also are checked for sales area temperature, humidity, dew point, as well as, outside air temperature, humidity and dew point. The receiver liquid level sensors are calibrated where present. Electronic and Mechanical level readings are recorded. Where building control system (BCS) case discharge air temperature sensors are present, the temperatures are verified using data obtained during the temperature audit by comparing audit discharge air (DA) temperatures with DA temperatures on the BCS control panel display. The temperatures should agree within about plus or minus two (2) degrees Fahrenheit. The BCS DA temperatures are then recorded.

The collection of basic system information at step 116 will now be described. The oil levels and pressures for each compressor are measured and recorded. The BCS receiver level reading is checked against a mechanical gauge, where present and recorded. When required by the application, an oil sample is taken from one compressor on every rack using the following procedure. Oil may be removed from the compressor at the drain plug or at the oil fill hole. At least a one (1) ounce sample of oil is taken in a labeled, clean oil-sampling bottle. The sample is checked for acid and other contaminants and recorded. The sample is then labeled for further testing off-site.

The receiver levels are then recorded with the heat reclaim valve off and on, the gas defrost valve off and on, and both valves off and on. The values are recorded. The levels are then allowed to stabilize after each change is made before reading and recording a new receiver level.

The condenser holdback valve setting is then checked. The holdback valve maintains condensing pressure, liquid line pressure, and, indirectly, compressor discharge pressure, during periods of low outside ambient temperatures. Condensing pressures are maintained above certain minimums both to protect the compressor and to provide sufficient pressure differential for proper expansion valve operation at the refrigerated fixture evaporators. The pressure setting of the holdback valve sets a minimum system condensing pressure. To check the setting of the holdback valve, first a calibrated discharge pressure gauge is connected to the compressor discharge service valve. The outside ambient temperatures are then verified to be about ten (10) degrees Fahrenheit below the desired minimum condensing pressures and temperatures. The condenser pressures are lowered by any of the following or a combination thereof: forcing on all condenser fans, sprinkling water on air-cooled condensers, reducing the system load by shutting down circuits and shutting off the compressors. The lowest pressure the valve allows the system condensing pressure to fall is then recorded.

The receiver pressurization valve is then checked. The receiver pressure is regulated by the receiver pressurization valve, which opens when the receiver pressure is too low. This allows high-pressure hot gas to enter the receiver. A calibrated high-pressure gauge is connected to a gauge tap on or near the receiver 52. A second calibrated high pressure gauge is connected on the drop leg before the hold back valve. The two pressure readings are then recorded.

The system is then checked at step 118 for excessive component pressure drops. To measure pressure drops in general, two service gauges are calibrated and placed before and after the specified valves. The pressure drops are recorded preferably during periods of peak load. To measure refrigeration system temperatures such as liquid filter inlet and outlet using the infrared temperature measuring gun 100, the gun targeting beam is pointed at the subject pipe or device at a point with as dark and dull of a surface as possible. The round, rotating laser target circle must not overlap the area of interest.

The pressure drop across the liquid line filters are measured by attaching a gauge at or as close to possible to the filter inlet and outlet. The system pressures are allowed to stabilize before a reading is recorded. Preferably, the maximum liquid line filter-drier maximum pressure drop is about one (1) psig or less for a low temperature circuit (e.g., less than zero (0) degrees Fahrenheit saturated suction temperature), about two (2) psig or less for a medium temperature circuit (e.g., between zero (0) and thirty-five (35) degrees Fahrenheit saturated suction temperature) and about two (2) psig or less for a high temperature circuit (e.g., greater than thirty-five (35) degrees Fahrenheit saturated suction temperature). If filter has a sight glass, the color of the material is recorded. If no suitable pressure taps are available, the infrared gun is used to measure the filter inlet and outlet temperatures. If the device has a measurable temperature, the pressure drop will be excessive. Again, where pressure drops larger than the guidelines set forth, the liquid filter core is replaced and the pressure drop is re-measured.

To measure high-side discharge-to-liquid pressure drops, gauges are connected at the compressor discharge header and in the drop leg from the condenser before any holdback valves. The pressures are recorded after appropriate valves are switched on or off. The system pressures are allowed to stabilize before recording a reading. Next, the pressures are recorded for gauge readings according to the following conditions: (1) without heat reclaim and gas defrost energized, (2) with heat reclaim only energized, (3) with gas defrost only energized, and (4) with heat reclaim and gas defrost energized.

Preferably, the high-side discharge to liquid pressure drop (between discharge header and condenser output) is about six (6) psig or less for a low temperature rack, about eight (8) psig or less for a medium temperature rack, and about ten (10) psig or less for a high temperature rack. Where pressure drops larger than these guidelines, the additional following measurements are taken to isolate the source of pressure drop. These measurements, as will be described in greater detail below, include oil separators, heat reclaim three-way valves, discharge gas defrost boost valve and liquid line gas defrost differential boost valves.

The pressure drop across the oil separators is measured by attaching the gauge at or as close as possible to the oil separator inlet and outlet. Compressor discharge pressure is an acceptable substitute for the inlet-side pressure. Again, the system pressures are allowed to stabilize before recording a reading. Preferably, the maximum oil separator line filter-drier maximum pressure drop is about one (1) psig or less for a low temperature rack, about two (2) psig or less for medium temperature rack, and about two (2) psig or less for a high temperature rack. When pressure drops are greater than about ten (10) psig, the condition is recorded and investigated further as a service issue.

The pressure drop across the three-way valves are measured by attaching the gauge at or as close as possible to the three-way valve inlet and outlet. The pressure drop is measured with the valve energized and de-energized. System pressures are allowed to stabilize before recording readings. Preferably, the maximum three-way valve maximum pressure drop is about three (3) psig or less for low temperature rack, about three (3) psig or less for medium temperature rack, and about three (3) psig or less for high temperature rack. A pressure drop greater than about ten (10) psig indicates a significant issue demanding further investigation.

The pressure across the discharge gas defrost boost valve is measured by attaching one of the high pressure gauges to a source of discharge pressure before the valve and the second to the liquid header. The pressure drop is checked with the valve energized and de-energized. The system pressures are allowed to stabilize and the values are recorded. Preferably, the maximum discharge gas defrost boost valve pressure drop is about thirty (30) psig or less for all settings. When pressure drops larger than about forty (40) psig, the condition is recorded and investigated further as a service issue. Typically, the valve is replaced.

The liquid line gas defrost differential boost valves are checked by attaching the gauge at or as close as possible to the valve inlet and outlet. The pressure drop is measured with the valve energized and de-energized. The pressures are allowed to stabilize and the readings are recorded. The guideline maximum defrost boost valve pressure drop setting for all temperatures is about twenty (20) psig or less. When pressure drops larger than about forty (40) psig, the condition is recorded and investigated further as a service issue.

The defrost boost valves are adjusted where necessary. With all circuits in normal operation, the boost valve is forced on. The regulator is adjusted to about twenty-five (25) pound differential. One large circuit is forced into defrost. After about five (5) minutes, the differential is rechecked. After adjustments are made to defrost boost valves, the store is checked for the most difficult to defrost system. This usually is verified to be the defrost with the longest pipe length. A defrost is forced and the temperatures and pressures are monitored. If operating system condensing pressures are lowered, the defrost boost valves are checked again.

The pressure drop across each suction line filter is measured by attaching a gauge at the filter or suction header and at an associated compressor. The system pressures are then allowed to stabilize before recording a reading. Preferably, the maximum line filter-drier maximum pressure drop is about one (1) psig or less for a low temperature rack, about two (2) psig or less for a medium temperature rack, and about two (2) psig or less for a high temperature rack. Where pressure drops larger than these guidelines, the filter drier cores are removed and the pressure drop is remeasured. The filters are examined for contamination and blockage. New cores are installed where appropriate.

The compressor operation and efficiency is checked using the following procedure. The refrigeration system should be controlled by the electronic controls. All mechanical backup control devices outside the operating envelope of the electronic primary controls are adjusted. The mechanical low-pressure controls where present are set to about five (5) psig below the rack-controller minimum suction-pressure set point. Similarly, the mechanical high-pressure controls where present are set to about twenty (20) psig above the rack-controller head-pressure set point.

If adjustment is required, the following steps are performed: (1) The low pressure gauge is zeroed; (2) the low pressure gauge is attached to the suction service valve; (3) the electronic compressor control is overrided to the "on" position; (4) the suction service valve is front seated; (5) the suction service valve is slowly cracked and the pressure is noted according to when the compressor starts; (6) the cut-in switch is adjusted first, then the differential to approximate a cut-in setting of about twenty (20) psig over the electronic control setpoint and a cutout setting of about zero (0) to about one (1) psig; (7) the suction service valve is front seated again; (8) about the new cut-in and cut-out is noted; and (9) steps 4–7 are repeated until the desired settings are achieved.

The compressor efficiency is then tested using a load amperage check or a pump-down test method. For the load amperage check method, the compressor model number, refrigerant used, the suction pressure at the service valve, the discharge pressure at the service valve, the voltage at the compressor terminals and the current is recorded. For the pump down test method, a zeroed low pressure gauge is attached to the compressor suction service valve. The low pressure control is jumped "on". The suction service valve is front seated. The compressor is forced on. The lowest pressure achieved is noted. Finally the compressor is turned off and the time to rise to about ten (10) psig is recorded.

The electronic controller compressor minimum on/off time delays are reset to about zero (0) seconds. Each compressor is then turned on and off individually using the rack controller. The compressor being controlled is verified. The time delays having unusually long response time or compressors not under BCS control are recorded. The time delays are then restored to original values.

Using an ammeter the compressor unloaders are tested where present. The compressor with the unloader is turned on. The clamp on the ammeter is applied to the compressor power leads. A reading is taken and recorded. The unloader step in the rack controller is turned on. The rise in compressor amperage is noted on the ammeter and recorded.

The racks and condensers operation and efficiency is then checked according to the following procedure. If the condenser is air cooled, the condenser surface is cleared of dirt and other material. Photographs of the condenser surface are taken. Any observations are recorded. If the condenser is evaporative cooled, the condenser surface is observed for scaling. Photographs are taken of the condenser with special attention to any scaled areas. The observations are recorded.

The condenser fans are monitored to verify proper operation. The BCS condenser fan minimum on/off time delays are reset to about zero (0) seconds. Each condenser fan (or fan pair when controlled in groups of two) is then overrided "on," then "off," using the rack controller (as opposed to relay board or override switches). Where variable frequency drive control is used, the controller is forced to ramp the fan to full speed, then minimum speed by changing the setpoint or warming then cooling the controlling air or sump temperature sensor. The condenser fan is verified to be under BCS control. The time delays are restored to original values. Any unusually long response times are recorded. If the condenser is evaporative cooled, the circulating pump is verified to be running. If a backup circulating pump and automatic switchover controls are provided, the primary circulation pump is shut off. The backup is monitored to verify if it starts and pumps. If the backup pump is provided with manual controls, the primary pump is turned off and the backup is turned on. Observations are then recorded.

Next, the accuracy and location of any temperature control devices is observed and verified. The inverter drive operation and set up is also verified for accuracy. Using pressure and temperature readings and computational procedure, each system is checked for non-condensables. While a refrigeration system ideally circulates pure refrigerant, if there are leaks in the system, air or other fluid may get inside. This air or other fluid is called non-condensable fluid. Non-condensable fluid causes the condenser pressure to run higher than expected, thereby causing energy consumption to increase.

This procedure may be conducted using two methods. The first method consists of measuring and recording the outside ambient temperature. For air-cooled condensers, about fifteen (15) degrees Fahrenheit is added to the ambient temperature. Next, the associated pressure in a pressure-temperature conversion chart is cross-referenced for the refrigerant in the subject system and recorded. For evaporative condensers, about twenty-five (25) degrees Fahrenheit is added to the ambient temperature. The associated pressure in a pressure-temperature conversion chart is cross-referenced for the refrigerant in the subject system and recorded. The actual pressure at the condenser and the drop leg (liquid) temperature is measured and recorded. The actual condenser pressure and the design condensing pressure are compared. The liquid temperature and the condensing temperature are also compared. If both differences are greater than about ten (10) psig or degrees Fahrenheit respectively, a gas sample is pulled from the system high point.

In a second method, the refrigeration system is shut down and the condenser refrigerant is allowed to reach ambient air temperature. If the condenser air pressure is higher than the pressure corresponding to the refrigerant temperature, non-condensable gases are present. For example, for R-22 ambient temperature of about ninety (90) degrees, the pressure should be about one hundred sixty-eight (168) psig. The gauge pressure must be adjusted for the altitude. The proper fan rotation is verified by confirming air flow direction.

The initial adjustments at step 120 will now be described in greater detail. Minimum head pressures are reduced to customer agreed upon setpoints, hereinafter referred to as "energy aggressive" setpoints, based on the method of defrost being used. The air-cooled condenser fan setpoints, hold-back valves, evaporator condenser sump temperature setpoints, and receiver pressurization valve are all adjusted. To change the condenser hold-back valve setting, a calibrated discharge gauge is connected to the compressor discharge service valve. The outside ambient temperatures are verified to be at least about ten (10) degrees below the desired minimum condensing pressures and temperatures. The condenser pressures are then lowered by any of the following or any of the combinations thereof: forcing on all condenser fans, sprinkling water on the air-cooled condensers, reducing the system load by shutting down the circuits and shutting off the compressors. The discharge pressure is then reduced to be below the desired setpoint by about twenty (20) to about twenty-five (25) psig. An isolation valve going to the receiver pressure valve is then shut off. The lock nut on the flooding valve is then loosened and the valve stem is backed out completely. The adjustment stem on the flooding valve is then turned most of the way in. The discharge pressure is verified to slowly rise. When the pressure rises about ten (10) to about fifteen (15) psig above the desired setpoint, the adjustment stem is backed out until the valve dumps. A sudden drop in discharge pressure will indicate that the valve has dumped. The system is then allowed to stabilize and the flooding valve is adjusted to the desired setpoint. The forced condenser fans, circuits, and compressors are all returned to normal running conditions. The receiver pressurization valve is re-adjusted where present to predetermined setpoints. All of the above setting changes are recorded. The receiver levels are again re-checked and recorded.

Next, the resulting case discharge air temperatures are observed and compared at step 122 to initial case discharge air temperatures previously recorded, as well as manufacturers' design discharge air temperatures. Drops in return gas temperatures, which indicate circuit floodback, are monitored.

Troubleshooting the temperature of the refrigerated fixtures will now be described. First, the fixture is inspected and the discharge air velocities are recorded using an accurate velometer. The first fixture to be checked in each store must be checked with both velometers to provide a check of meter accuracy. The air velocities are then recorded at two-foot intervals across the entire discharge air plenum. Where low air flow is indicated, the fixtures are investigated for coil icing and/or evaporative fan failure. Next, the suction pressure at each case is checked. If a high pressure is indicated, the piping is monitored for excessive pressure drops. If suction pressure and air flow are correct, the degrees of subcooling or presence of flash gas are investigated. The superheat conditions of refrigeration fixtures are adjusted where necessary. Any non-correctable system performance deviation is noted.

The suction operating condensing pressures are raised at step 124 according to the following procedure. The floating suction pressure strategy is disabled if in use. The suction setpoints are then raised to "energy aggressive" setpoints. The resulting case discharge air temperatures are observed and compared to initial case discharge air temperatures recorded and to manufacturers' design discharge air temperatures. The refrigerated fixtures or circuits where a rise in discharge air temperatures or an increase in floodback is seen above the levels recorded during earlier procedures and inspections are troubleshooted according to the aforementioned procedure. The system suction return gas superheats are rechecked for unacceptably low values. The electronic pressure regulator (EPR) setting for any circuit is backed out where EPR pressure drop is forcing lower than required rack suction pressures. When all fixture temperature issues have been fully identified and resolved, the floating suction pressure strategy is enabled or re-enabled if available using "energy aggressive" setpoints.

The resulting rack and fixture performance is observed with special attention to the following conditions: (1) compressor short cycling, running on programmed time delays, or more than one cycle on average over five minutes; (2) any rise in fixture temperatures; (3) condenser fan short cycling (on/off cycles or less than one minute) delays or hunting if variable frequency drive; and (4) critically low receiver levels.

The heat reclaim and gas defrost where used are energized and checked for performance problems. Any additional control sequences (i.e., split condenser, surge, heat reclaim override, etc.) are verified. A simulation as required is performed to assure satisfactory operation of the control system. The BCS setpoints, which are the computerized electronic systems used to control the refrigeration, HVAC, anticondensate heaters, lighting or other building systems and equipment in the store, are reprogrammed to reflect any remaining "energy aggressive" setpoints.

A final review of the system operation is conducted. Additional verifications and adjustments are performed to operating setpoints, schedules, control algorithm selections, and other system parameters required to ensure they are working in conjunction with each other in a cohesive manner to provide optimum refrigeration system performance with correct fixture temperatures and lowest possible energy consumption. Once again, the resulting rack and fixture performance is observed. Any fixture adjustments or correction activities are recorded.

Alarm verification at step 126 is then programmed to connect with the remote monitor. A temperature alarm is forced to connect to the remote monitor 7 in order to verify the alarm.

The ACH, defrost, HVAC, and lighting systems are monitored and adjusted at step 128. For the ACH system, the current setpoints are recorded. The ACH system is then adjusted according to the following setpoints: for about fifty (50) percent or greater relative humidity or a store dewpoint exceeding about sixty (60) degrees Fahrenheit, the control system is set to about ninety (90) percent power level; for about thirty-five (35) percent or lower relative humidity or a store dewpoint less than about forty (40) degrees Fahrenheit, the control system is set to about ten (10) percent power level. A clamp-on ammeter is placed around any anti-sweat power conductor to confirm cycling operation rate and time. The antisweat triacs or contacts are visually checked to confirm they have not been jumped out.

The time settings of mechanical defrost clocks as well as BCS time are adjusted if necessary. Any defrost issues identified earlier are investigated. This would include frequency of defrost, duration of defrost, and defrost termination setpoints of each circuit.

To calibrate the HVAC system, the store temperature and humidity are recorded. Using a hand-held device such as a sling psychronometer, the store temperature and humidity is determined at the frozen food aisle, the meat case aisle or any other area where a humidity sensor is located. The sales area temperature and humidity sensors are confirmed not to be affected by temporary or permanent lighting, hot air from spot coolers or other self-contained cases, or other sources of reading errors. The readings are recorded. The HVAC unit filters are checked for plugged conditions. The operation of the heat reclaim and auxiliary heat is verified. The fan speed and output in cubic feet per minute are adjusted to "energy aggressive" setpoints. Once set, each stage of heating and cooling is confirmed for operation. Any observations are recorded. Dehumidification control is established wherever possible. The state of sales area pressurization verses outside ambient pressure is determined where possible.

The store lighting is then calibrated. The store sales area lighting sensor is located and a reading is taken from a light meter and recorded. The store light sensor reading at the BCS is recorded, and the two readings are compared. If there is more than about five (5) foot candles (FC) difference, the store sensor is adjusted if possible or program offset. Any adjustments are recorded. The BCS lighting control setpoints versus preferred lighting setpoints are monitored. Increases and decreases in lighting levels are then simulated, and the proper staging of lighting up and down is verified. The store light sensor is shaded gradually, or the light levels are raised with a flashlight if already on. Portable light meter readings are observed as the lights stage up and down. The readings are recorded.

Time changes are then simulated according to the following procedure to confirm proper cycling of lighting on and off. First, the time in the BCS is changed to an off time for each or all lighting groups. The time is changed in the BCS to just prior to scheduled lighting "on" times. The BCS is allowed to cycle the lights on as in normal operation. The correct lighting groups are verified to be turned on. Any uncontrolled lighting is investigated.

In the method described above, various data are recorded. As used herein, "recorded" means writing the observed data on a form to be completed by service personnel, or input into a hand-held or other computer for storage. In this way, the data may be recorded by handwriting it onto a form for input to writeable memory for reference and use later.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for improving system performance, comprising:

(A) installing a temperature monitoring system for a refrigeration system;

(B) performing a temperature audit on at least one refrigeration case of the refrigeration system;

(C) calibrating at least one temperature sensor and at least one pressure sensor of the refrigeration system;

(D) obtaining operating parameters of the refrigeration system;

(E) testing at least one of multiple components of the refrigeration system by performing at least one of a pressure drop test and an efficiency test on the at least one component of said multiple components; and (F) adjusting at least one of operating pressure and operating temperature of the at least one component of said multiple components.

2. The method of claim 1, further comprising troubleshooting the refrigeration system to obtain desired temperature readings.

3. The method of claim 1, further comprising adjusting an HVAC system according to desired setpoints.

4. The method of claim 1, further comprising adjusting internal lighting levels of a lighting system to desired setpoints.

5. The method of claim 1, wherein said installing a temperature monitoring system includes installing a suction return gas temperature monitor.

6. The method of claim 5, wherein said installing a suction return gas temperature monitor includes attaching temperature sensors to assigned suction lines.

7. The method of claim 1, wherein said performing a temperature audit includes performing a product temperature audit.

8. The method of claim 7, wherein said performing a temperature audit further includes measuring the discharge air temperature of the at least one refrigeration case.

9. The method of claim 1, wherein said obtaining operating parameters of the refrigeration system includes measuring an oil level in the reservoir and plurality of compressors.

10. The method of claim 1, wherein said obtaining operating parameters of the refrigeration system includes testing an oil sample from a compressor for contaminants.

11. The method of claim 1, wherein said obtaining parameters includes measuring an oil level in a receiver with a heat reclaim valve in a first position and a hot gas defrost valve in a second position.

12. The method of claim 11, wherein the first position is on and the second position is off.

13. The method of claim 11, wherein the first position is off and the second position is on.

14. The method of claim 11, wherein the first position is on and the second position is on.

15. The method of claim 11, wherein the first position is off and the second position is off.

16. The method of claim 1, wherein said obtaining operating parameters of the refrigeration system includes verifying the holdback valve setting.

17. The method of claim 16, wherein said verifying the holdback valve setting further includes lowering the pressure in the condenser.

18. The method of claim 1, wherein said obtaining operating parameters of the refrigeration system includes verifying a receiver pressurization valve setting.

19. The method of claim 18, wherein said verifying the receiver pressurization valve setting includes simultaneously measuring pressures upstream and downstream of the receiver.

20. The method of claim 1, wherein the refrigeration system includes a liquid line filter, and said pressure drop test includes measuring a pressure drop across the liquid line filter.

21. The method of claim 1, wherein said pressure drop test includes measuring high side to liquid pressure drops with a heat reclaim and a gas defrost valves in a first and second position.

22. The method of claim 21, wherein said measuring high side to liquid pressure drops includes measuring the pressure drop from the discharge header to a location downstream of the condenser and upstream of the holdback valve.

23. The method of claim 21, wherein the first position is on and the second position is off.

24. The method of claim 21, wherein the first position is off and the second position is on.

25. The method of claim 21, wherein the first position is on and the second position is on.

26. The method of claim 21, wherein the first position is off and the second position is off.

27. The method claim 26, further including conducting pressure measurements when the pressure drop exceeds a predetermined value.

28. The method of claim 27, wherein the predetermined value is about 6 psig to about 10 psig.

29. The method of claim 27, wherein the refrigeration system includes an oil separator, and said conducting additional pressure measurements includes measuring a pressure drop across the oil separator.

30. The method of claim 29, wherein said measuring a pressure drop across the oil separator further contacting a supervisor when the pressure drop exceeds a predetermined value.

31. The method of claim 30, wherein the predetermined value is about 10 psig.

32. The method of claim 27, wherein said conducting additional pressure measurements further includes measuring a pressure drop across the heat reclaim valve when the heat reclaim valve is in a predetermined position.

33. The method of claim 32, wherein the predetermined position is on.

34. The method of claim 32, wherein the predetermined position is off.

35. The method of claim 32, wherein said measuring a pressure drop across the heat reclaim valve further includes contacting a supervisor when the pressure drop exceeds a predetermined value.

36. The method of claim 35, wherein the predetermined value is about 10 psig.

37. The method of claim 27, wherein said conducting additional pressure measurements further includes measuring a pressure drop across the gas defrost valve when the gas defrost valve is in a predetermined position.

38. The method of claim 37, wherein the predetermined position is on.

39. The method of claim 38, wherein the predetermined position is off.

40. The method of claim 37, wherein said measuring a pressure drop across the gas defrost valve further includes contacting a supervisor when the pressure drop exceeds a predetermined value.

41. The method of claim 40, wherein the predetermined value is about 40 psig.

42. The method of claim 27, wherein said conducting additional pressure measurements further includes measuring a pressure drop across a liquid line gas defrost differential boost valve when the liquid line gas defrost differential boost valve is in a predetermined position.

43. The method of claim 42, wherein the predetermined position is on.

44. The method of claim 42, wherein the predetermined position is off.

45. The method of claim 42, wherein said measuring a pressure drop across the liquid line gas defrost differential boost valve further includes contacting a supervisor when the pressure drop exceeds a predetermined value.

46. The method of claim 40, wherein said predetermined value is about 40 psig.

47. The method of claim 27, wherein said conducting additional pressure measurements further includes adjusting the liquid line gas defrost differential boost valve.

48. The method of claim 47, wherein said adjusting the liquid line gas defrost differential boost valve includes forcing the liquid line gas defrost differential boost valve to an on position.

49. The method of claim 48, wherein said adjusting the liquid line gas defrost differential boost valve further includes adjusting the differential to 25 psig.

50. The method of claim 48, wherein said adjusting the liquid line gas defrost differential boost valve includes activating one of the plurality of circuits to a defrost condition.

51. The method of claim 27, wherein said conducting additional pressure measurements further includes measuring a pressure drop across a suction filter.

52. The method of claim 51, wherein said measuring a pressure drop across the suction filter includes replacing a filter drier core when pressure drops above a predetermined guideline.

53. The method of claim 52 wherein said predetermine guideline is about 1 psig to about 2 psig.

54. The method of claim 1, further comprising preparing the refrigeration system to be controlled by electronic controls.

55. The method of claim 54, wherein said preparing the refrigeration system to be controlled by electronic controls includes adjusting mechanical backup controls outside operating parameters of electronic controls.

56. The method of claim 55, wherein said adjusting mechanical backup controls includes adjusting mechanical low pressure controls to a predetermined level below a rack suction pressure set point.

57. The method of claim 56, wherein the predetermined level is about 5 psig.

58. The method of claim 55, wherein said adjusting mechanical backup controls includes adjusting mechanical high pressure controls to a predetermined level above a rack head pressure set point.

59. The method of claim 58, wherein the predetermined level is about 20 psig.

60. The method of claim 1, wherein said efficiency test includes testing compressor efficiency.

61. The method of claim 60, wherein said testing compressor efficiency includes measuring the suction pressure upstream of the compressor and the discharge pressure downstream of the compressor.

62. The method of claim 60, wherein said testing the compressor efficiency includes turning the rack controller on and off to verify that the compressor is being controlled.

63. The method of claim 1, wherein said efficiency test includes testing the electrical current of a compressor unloader.

64. The method of claim 1, further comprising verifying that an air-cooled condenser surface is free of debris.

65. The method of claim 1, further comprising checking an evaporatively-cooled condenser surface for scaling.

66. The method of claim 1, further comprising verifying that a condenser fan is operational.

67. The method of claim 1, further comprising verifying that a circulating pump is operational.

68. The method of claim 1, further comprising checking a condenser for non-condensables.

69. The method of claim 1, wherein said adjusting operating pressures of at least one component includes lowering operating condensing pressures.

70. The method of claim 69, wherein said lowering operating condensing pressures includes reducing minimum head pressures.

71. The method of claim 70, wherein said reducing minimum head pressures includes adjusting fan setpoints for a condenser.

72. The method of claim 70, wherein said reducing minimum head pressures includes adjusting a hold back valve.

73. The method of claim 72, wherein said adjusting the holdback valve includes lowering the condensing pressure.

74. The method of claim 73 wherein said lowering the condensing pressure includes forcing a condenser fan on.

75. The method of claim 73 wherein said lowering the condensing pressure includes sprinkling water on air cooled condensers.

76. The method of claim 73 wherein said lowering the condensing pressure includes shutting down a refrigeration circuit.

77. The method of claim 73 wherein said lowering the condensing pressure includes shutting down a compressor.

78. The method of claim 72, wherein said adjusting the holdback valve includes reducing discharge pressure a predetermined amount below a desired setpoint.

79. The method of claim 78, wherein the predetermined amount is about 20 psig.

80. The method of claim 72, wherein said adjusting the holdback valve includes turning off an isolation valve.

81. The method of claim 72, wherein said adjusting the holdback valve includes backing out an adjustment stem until the holdback valve dumps.

82. The method of claim 1, further comprising troubleshooting the refrigeration cases identified as over-temperature.

83. The method of claim 82, wherein said troubleshooting the refrigeration cases includes checking the refrigeration cases for low airflow.

84. The method of claim 1, further comprising remotely monitoring the refrigeration system.

85. The method of claim 84, wherein said remotely monitoring includes tracking system stability.

86. The method of claim 1, wherein said testing said at least one of multiple components of the refrigeration system further includes testing operating pressure of at least one component.

87. The method of claim 1, wherein said testing said at least one of multiple components of the refrigeration system further includes testing operating temperature of at least one component.

88. The method of claim 1, wherein said installing a temperature monitoring system includes installing a suction line return gas temperature monitoring system.

89. The method of claim 1, further comprising calibrating service gauges prior to said testing multiple components of the refrigeration system.

90. The method of claim 1, further comprising adjusting an anti-condensate heater to desired setpoints.

91. The method of claim 1, further comprising tracking resulting system stability.

* * * * *